United States Patent [19]

Lane

[11] 3,948,353

[45] Apr. 6, 1976

[54] EXTENSION LADDER

[76] Inventor: John G. Lane, No. 4 Perity Lane, Pittsburgh, Pa. 15220

[22] Filed: Mar. 20, 1974

[21] Appl. No.: 452,918

[52] U.S. Cl. ..... 182/206; 182/107; 182/207

[51] Int. Cl.[2] ..... E06C 5/36; E06C 7/48

[58] Field of Search ..... 182/206, 107, 108, 119, 182/22

[56] References Cited

UNITED STATES PATENTS

| | | | |
|---|---|---|---|
| 466,816 | 1/1892 | Wilson | 182/108 |
| 1,035,770 | 8/1912 | Blair | 182/22 |
| 1,351,146 | 8/1920 | Zerlini | 182/22 |
| 2,963,104 | 12/1960 | Roth | 182/206 |
| 3,115,212 | 12/1963 | Keatley | 182/108 |
| 3,481,428 | 12/1969 | Merritt | 182/207 |

FOREIGN PATENTS OR APPLICATIONS

| | | | |
|---|---|---|---|
| 680,797 | 9/1939 | Germany | 182/107 |

*Primary Examiner*—Reinaldo P. Machado
*Attorney, Agent, or Firm*—William J. Ruano

[57] ABSTRACT

An extension ladder in which the extension part has a plurality of striated cut-out portions along the leaning edge to serve as hooks for hooking onto a gutter or top edge of a sidewall or roof of a building to prevent lateral or vertical sliding. A lining of rubber or similar material is preferably provided in the cut-out portion to provide an anti-skid surface to further prevent lateral sliding.

6 Claims, 10 Drawing Figures

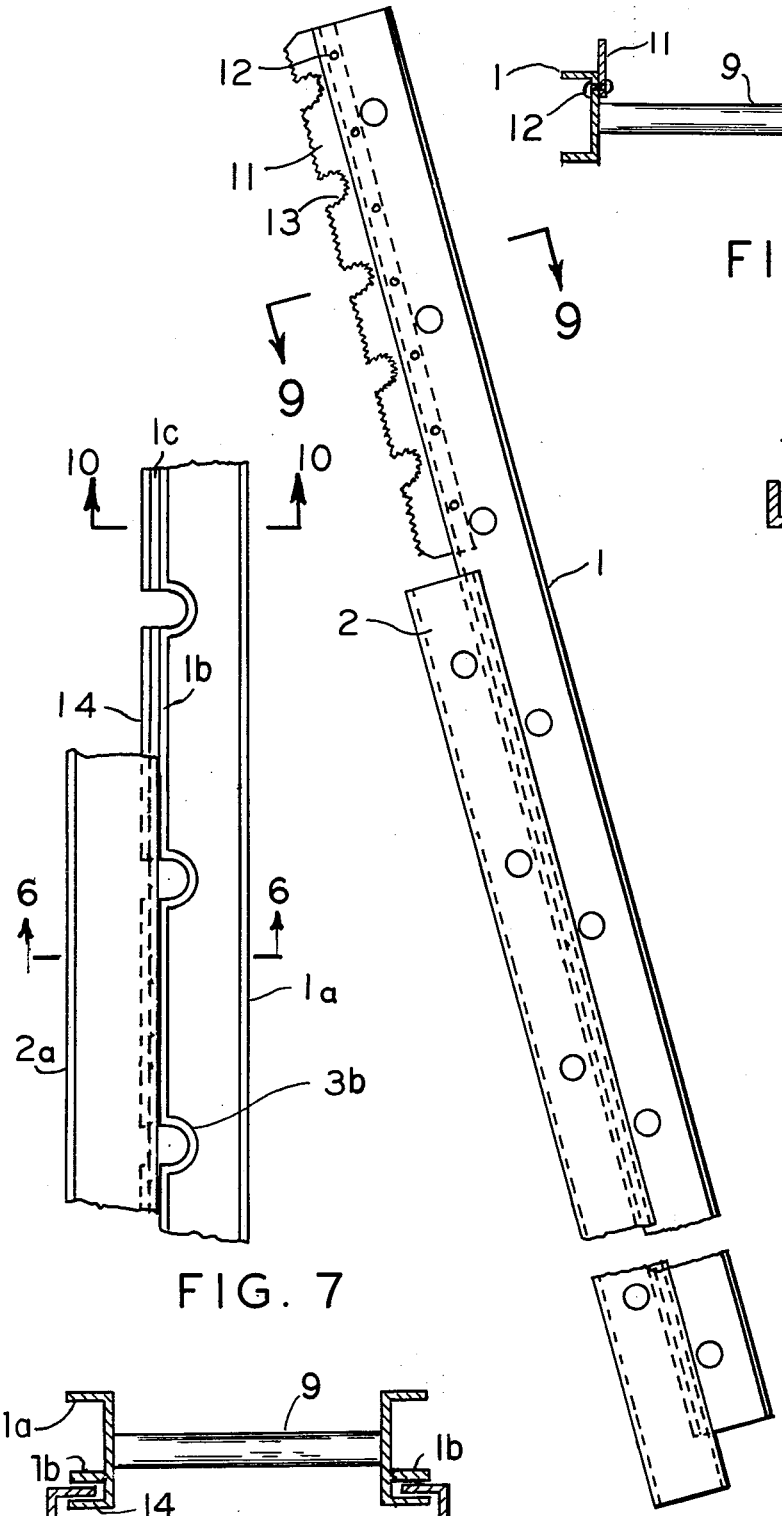
FIG. 7
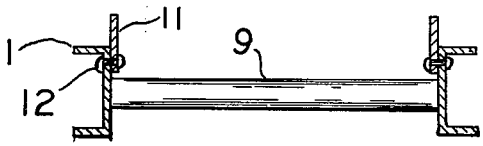
FIG. 9
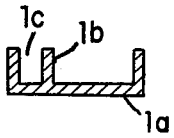
FIG. 10
FIG. 8
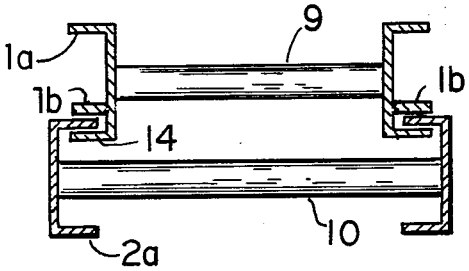
FIG. 6

EXTENSION LADDER

This invention relates to an extension ladder and, more particularly, to safety features embodied therein to prevent lateral or vertical sliding of the ladder when leaning against a roof or the like.

An outstanding disadvantage of extension ladders as commonly used is that the top end, which leans against a roof or the like, is not securely held in place and tends to slide laterally or vertically, therefore often resulting in severe injuries.

While attempts have been made in the past to overcome this problem, such as by the attachment of chains with hooks on their ends, these have not proved to be practical, therefore have not been adopted commercially.

An object of my invention is to provide an extension ladder which is devoid of the abovenamed disadvantages by providing a construction of the extensible portion of the ladder such as to provide an assured hold onto the edge of the gutter or other projection from a building sidewall against which the ladder is leaned.

A more specific object of the invention is to shape spaced portions of a ladder extension in a manner so as to hook onto a gutter or other projection from the sidewalls of the building to prevent the tendency of sliding of the ladder away from the building wall.

Other objects and advantages will become more apparent from a study of the following description taken with the accompanying drawing wherein:

FIG. 6 is a cross-section taken along line 6—6 of FIG. 1;

FIG. 7 is a fragmentary, elevational view of a modification embodying an additional guiding flange on the extension.

FIG. 8 is an elevational view of a modification having an attachment on the extension;

FIG. 9 is a cross-section taken along line 9—9 of FIG. 8; and

FIG. 10 is a cross-section taken along line 10—10 of FIG. 7.

Figure 1:
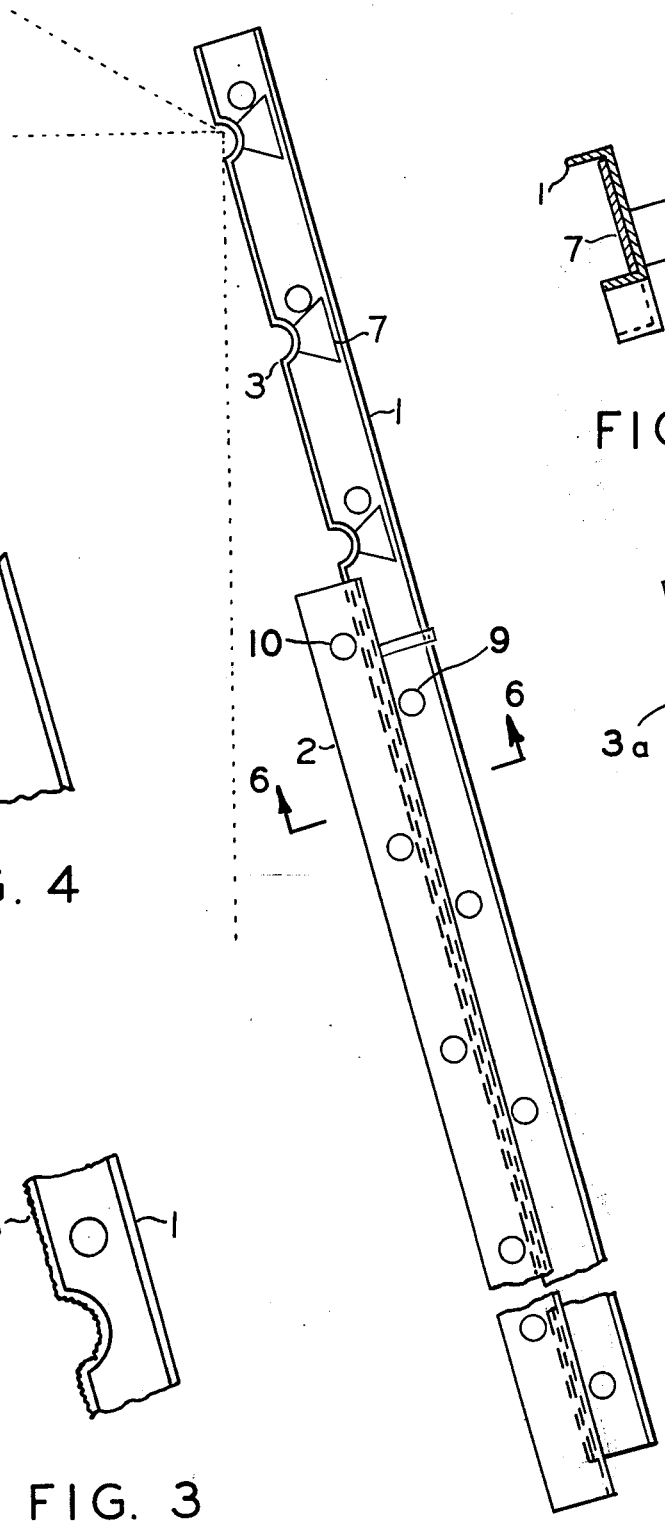
FIG. 1 is an elevational view of an extension ladder embodying the safety features of the present invention.
Figure 2:
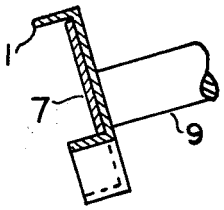
FIG. 2 is a transverse, enlarged, cross-sectional view through a cut-out or hook portion of the extension in FIG. 1.

Referring more particularly to FIGS. 1 and 2 of the drawing, numeral 1 denotes an extensible part of a ladder 2 which is relatively slidable therewith, -that is, by having the bottom flanges of the sides of the extensible part ride on the rungs 4 of the ladder 2. It should be noted that such bottom flanges of extensible part 1 may also slide along the top flanges of the sides of ladder 2 in certain well known types of extension ladders (FIG. 6 exclusive of flanges 1*b*).

In accordance with the present invention, the lower or leaning flange of the sides of extensible part 1 is provided with spaced, laterally registering, cut-out portions 3 so that any one pair of such cut-out portions may be rested against a gutter or top corner portion of a building, as shown in dotted outline, so as to hook the top portion of the ladder securely against such corner or any other projection of a building wall and thus provide considerably greater safety against either lateral or vertical sliding movement of the ladder relative to the sidewall of the building.

The cut-out portions may be flanged as shown to provide greater strength or reinforcement. Due to partial weakening of the ladder by such cut-out portions 3, reinforcing tabs 7 may be integrally secured to the web or the flanged sides of the ladder extension 1 immediately adjacent each cut-out portion 3.

Figure 3:
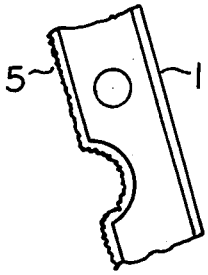

FIG. 3 shows a lining 5 of rubber or other similar resilient, anti-skid material, preferably with serrations or indentations, to provide even greater resistance against sliding because of the much greater frictional resistance provided by liner 5.

Figure 4:
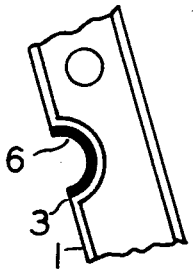
FIGS. 3 and 4 are enlarged, fragmentary, elevational views showing different anti-skid linings.
Figure 5:
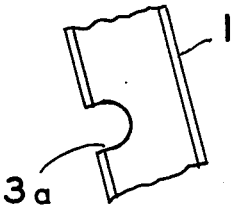
FIG. 5 is a fragmentary plan view of a modification showing an arcuate cut-out without a surrounding flange.

FIG. 4 shows a modification wherein arcuate liners 6 only, of rubber or other anti-skid material, may be adhered to the arcuate cut-out portion 3 to prevent slipping away from the projection on the building against which it is leaned, -such as a gutter or roof.

While in the extension ladder of the type illustrated the cut-outs 3 may extend the entire length,— in other types, wherein the flanges of the sides slide against each other, it would be more practical to have the cut-outs only in the top portion of the extensible part 1 of the ladder.

In such instances, if the ladder were 20 ft. in length the extension part 1 could be extended initially to a total of 23 ft. or more in length so that the notched portions 3 will always be located beyond the end of the ladder 2, as shown in FIG. 1. Of course, if ladder 2 were 40 ft. long, the extension 1 could be extended to say about 43 ft. to 46ft. overall length so as to always extend beyond the top of ladder 2.

Selective cut-outs 3 may be engaged against the projection from the building wall for providing a resting ledge.

FIGS. 6, 7 and 10 show a modification to enable the cut-out portions surrounded by flanges 3*b* to slide relative to the main ladder portion 2*a* without interference, that is, without bumping the top edge of the ladder portion 2*a* against flange portions 3*b* which would prevent further sliding. This is accomplished by providing a bottom flange 14, slidable against lower surface of the top flanged portion of ladder 2*a* and by providing an additional top flanged portion 1*b* slidable along the top edge thereof. This provides a central longitudinal slot 1*c* or track therebetween and prevents the top flange of the ladder part 2*a* from bumping against the arcuate flanges 3*b*, as would otherwise be the case in the construction shown in FIG. — 1 without flange 1*b*.

FIG. 6 is a cross-section of the structure in FIG. 7 and, with the exception of the additional flange 1b, also represents a cross-section of FIG. 1.

FIGS. 8 and 9 show a still further modification, similar to FIG. 1 except that an attachment, denoted by numeral 11 which is serrated throughout its length and having spaced notches 13 along its length, is fastened, such as by bolts or rivets 12, to the extensible ladder part 1, increasing its width. It should be noted that, instead, the attached part 11 may be integrally formed, such as by welding or manufacturing it as a single piece with ladder portion 1 and thereby avoid the necessity of bolts or other fastening means 12. In this modification, the lower end of the attachment 11 would serve as a limit stop and abut against the top end of the main ladder portion 2. Ladder part 1 may be either the same length as part 2 or may be longer by the amount of the length of attachment 11.

It should be especially noted that while notches 3, 3*a*, 3*b* and 13 in the various modifications are illustrated as semi-circular in outline, they may, instead, be V-shaped or rectangular shaped or of other shapes to provide hook like cut-outs. Notches 3 may also be used on a single ladder.

Thus it will be seen that I have provided a highly safe extension ladder by a built-in plurality of notched out portions which are highly effective in hooking onto a gutter, ledge, or other projections from a building wall or other support; furthermore, I have provided an anti-skid lining for the notched out or hooked portions of an extension ladder to assure against sliding away from the building and attendant danger to the person climbing it.

While I have illustrated and described several embodiments of my invention, it will be understood that these are by way of illustration only and that various changes and modifications may be contemplated in my invention and within the scope of the following claims.

I claim:

1. An extension ladder comprising a first metallic ladder portion supportable on the ground and a second extensible metallic ladder portion being relatively slidable thereon, said extensible ladder portion having a plurality of spaced, notched out portions along one flanged edge of the sides thereof to provide hooks for attachment to a gutter or other projection from a building wall by selective relative slidable movement of the ladder portions to prevent the danger of sliding of the ladder away from the building wall, said extensible ladder portion having a pair of closely spaced, longitudinally extending flanges, one surrounding said notches, said flanges extending along said flanged edge of the sides thereof having said notches to provide a track for the corresponding flange of said first ladder portion to enable sliding past said notched out portions without interference from said flange portions which surround said notches.

2. An extension ladder for safely leaning against a building or other vertical structure, comprising a first metallic ladder portion supportable on the ground and a second extensible metallic ladder portion having sides with flanged edges facing said building and which are relatively slidable on said first metallic ladder portion, said second extensible ladder portion being further from said building when extended vertically and having, on the top extreme end portion of said flanged edges, a plurality of spaced, substantially semi-circular notched out portions for providing hooks solely for attachment to a gutter or other projection from said building by selective relative slidable movement of said ladder portions to prevent the danger of sliding of the top end portion of the ladder away from the building wall, said notched out portions being so shaped and sufficiently large so as to completely surround said gutter or other projection from the building and contact both sides of said projection.

3. An extension ladder as recited in claim 2 together with a lining of resilient material in each of said cut-out portions for providing anti-friction surfaces.

4. An extension ladder as recited in claim 3 together with an extension of said anti-friction lining along the edge of the sides of said extension ladder.

5. An extension ladder as recited in claim 2 together with a flat plate reinforcing means integrally secured to the web portion of said extensible ladder portion immediately adjacent said cut-out portions.

6. An extension ladder as recited in claim 2 wherein said second extensible ladder portion is longer than said first ladder portion and wherein all of said notched out portions therein are located in the top portion of excess length.

* * * * *